US010023992B2

(12) United States Patent
Krieger

(10) Patent No.: US 10,023,992 B2
(45) Date of Patent: Jul. 17, 2018

(54) HIDDEN DRYER DOOR SWITCH

(71) Applicant: ILLINOIS TOOL WORKS INC., Glenview, IL (US)

(72) Inventor: Jeffrey J. Krieger, Mukwonago, WI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 15/301,984

(22) PCT Filed: Feb. 27, 2015

(86) PCT No.: PCT/US2015/018022
§ 371 (c)(1),
(2) Date: Oct. 5, 2016

(87) PCT Pub. No.: WO2015/156918
PCT Pub. Date: Oct. 15, 2015

(65) Prior Publication Data

US 2017/0175321 A1 Jun. 22, 2017

Related U.S. Application Data

(60) Provisional application No. 61/977,316, filed on Apr. 9, 2014.

(51) Int. Cl.
*H01H 3/16* (2006.01)
*D06F 58/28* (2006.01)

(52) U.S. Cl.
CPC ..... *D06F 58/28* (2013.01); *H01H 3/161* (2013.01); *D06F 2058/2858* (2013.01); *D06F 2058/2877* (2013.01); *H01H 2205/002* (2013.01); *H01H 2231/012* (2013.01); *H01H 2235/01* (2013.01)

(58) Field of Classification Search
CPC .... H01H 2221/044; H01H 3/161; H01H 1/42; H01H 13/186; H01H 9/226; H01H 13/183; H01H 3/20; H01H 9/287; H01H 1/26
USPC ..... 200/329, 332, 457, 458, 61.71, 61.77
See application file for complete search history.

(56) References Cited

U.S. PATENT DOCUMENTS

| | | | | |
|---|---|---|---|---|
| 3,742,162 | A | 6/1973 | Wasemann | |
| 4,230,919 | A | 10/1980 | Schantz et al. | |
| 5,025,121 | A * | 6/1991 | Allen | H01H 1/38 200/254 |
| 5,147,992 | A * | 9/1992 | Eriksen | H01R 13/7032 200/275 |
| 2005/0077166 | A1* | 4/2005 | Kim | H01H 19/025 200/564 |

(Continued)

FOREIGN PATENT DOCUMENTS

| | | | |
|---|---|---|---|
| CN | 202277319 | U | 6/2012 |
| WO | 2009129073 | A1 | 10/2009 |

(Continued)

OTHER PUBLICATIONS

ISR and WO for PCT/US2015/018022 dated May 11, 2015.

*Primary Examiner* — Edwin A. Leon
*Assistant Examiner* — Ahmed Saeed
(74) *Attorney, Agent, or Firm* — Boyle Fredrickson, S.C.

(57) ABSTRACT

A latch switch assembly for an appliance or the like provides spring-loaded jaws to retain a latch strike when a door of the appliance is closed and a switch operator positioned behind spring-loaded jaws be activated by the latch strike when it is received.

13 Claims, 4 Drawing Sheets

(56) References Cited

U.S. PATENT DOCUMENTS

| | | | |
|---|---|---|---|
| 2009/0260198 | A1 | 10/2009 | Morgan et al. |
| 2013/0008046 | A1 | 1/2013 | Hapke et al. |
| 2013/0015049 | A1 | 1/2013 | Tengler et al. |

FOREIGN PATENT DOCUMENTS

| | | | |
|---|---|---|---|
| WO | 2011139506 | A1 | 11/2011 |
| WO | 2013/015049 | A1 | 1/2013 |

* cited by examiner

FIG. 1a
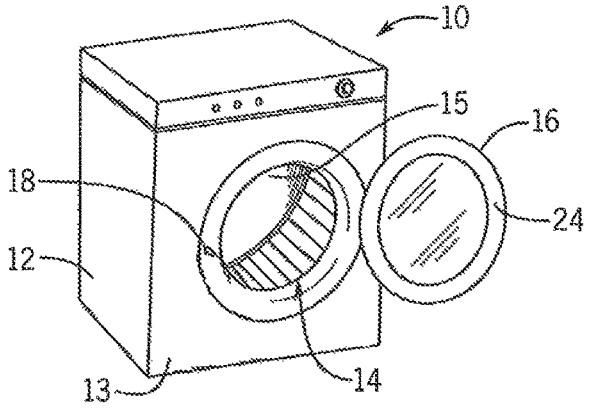
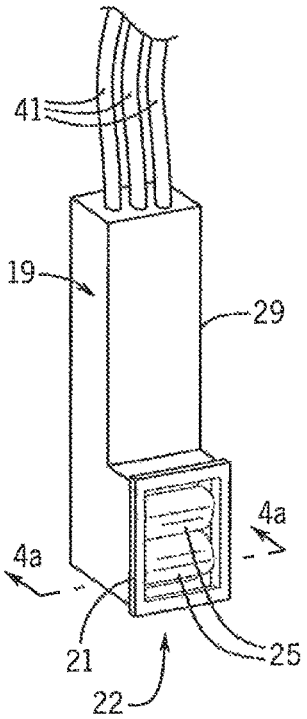
FIG. 1b
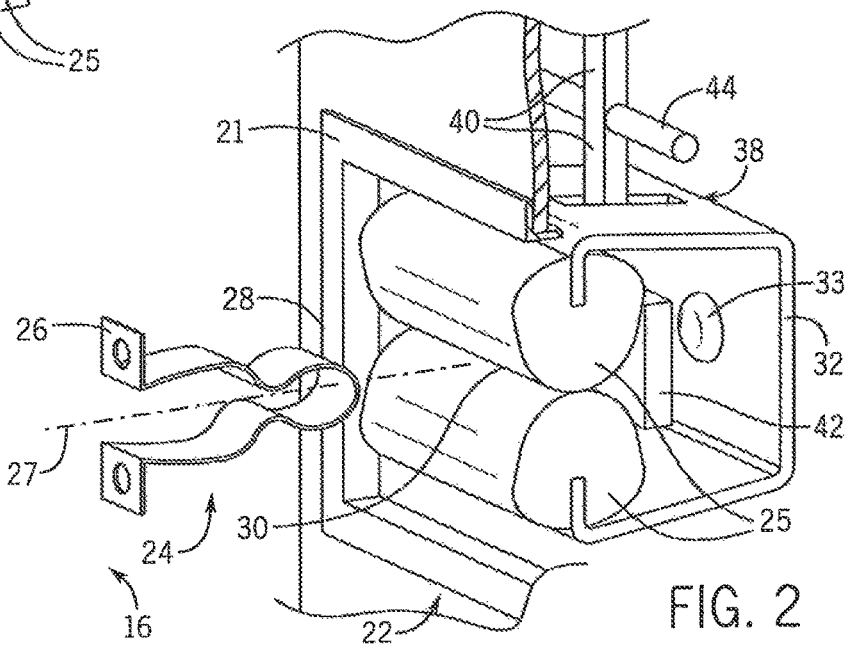
FIG. 2

HIDDEN DRYER DOOR SWITCH

CROSS-REFERENCE TO RELATED APPLICATIONS

This application is a National Phase of International Application No. PCT/US2015/018022 filed Feb. 27, 2015, and claims the benefit of U.S. provisional application 61/977,316 filed Apr. 9, 2014, and hereby incorporated by reference.

FIELD OF THE INVENTION

The present invention relates to an electrical switch having a pushbutton operator that is resistant to tampering.

BACKGROUND OF THE INVENTION

Modern appliances such as frontloading dryers may provide for lid or door switches detecting when the appliance lid or door is open. These lid switches turn off the appliance to allow the user unhampered access to the clothing in the machine and to protect the consumer from machinery moving inside the appliance. Such switches may provide a button or "switch operator" extending from the housing of the appliance to be activated by closing of the door, the latter which presses the button inward into the housing.

The switch operator may slide within a sleeve that provides for mechanical support to the switch operator guiding it in axial translation when the switch operator is pressed by the door. The sleeve may conform closely to an outer surface of the switch operator both to prevent the ingress of contaminants into the housing and to prevent caroming or jamming of the switch operator as it is pressed inward by the door. The sleeve may be stationary with respect to the housing and therefore sealed to the housing.

Contaminants such as water, bleach, fabric softener, and detergent that are blocked by the close fit between the sleeve and the switch operator may nevertheless accumulate and dry on the outer surface of the switch operator that protrudes from the housing when the door is open. Such contaminants can cause the switch operator to jam within the sleeve when it is retracted therein potentially allowing operation of the appliance even when the door is open.

To the extent that the switch operator is exposed and evident to the user, it invites tampering by pressing switch operator inward manually, without the door being closed, defeating the intent of the switch.

SUMMARY OF THE INVENTION

The present invention provides a switch operator that is hidden behind a conventional spring latch used in dryers and the like. In this way, the switch operator is removed from contamination and from casual tampering. In one embodiment, the switch operator may be supported on a downward cantilever to resist conducting contaminants into the switch mechanism.

Specifically then, in one embodiment the invention provides a latch switch assembly adapted to accept and retain a latch strike. The latch switch assembly includes a pair of jaw elements movable in separation toward and away from each other across an insertion axis and a spring element biasing the jaws toward each other so that they may separate to receive the latch strike along the insertion axis and hold the latch strike after receipt under force of the spring element. An electric switch has an operator positioned behind the jaw elements with respect to a direction of receipt of the latch strike along the insertion axis to be operated by the latch strike when so received.

It is thus a feature of at least one embodiment of the invention to provide an appliance latch and switch that may share the same opening in an appliance housing to reduce costs, tampering, and/or contamination.

The opposed jaw elements may be a polymer material.

It is thus a feature of at least one embodiment of the invention to provide a naturally lubricating material for smooth latch action and reduced wear.

The spring element may provide metal teeth fitting within the jaw elements to grip a latch strike positioned therebetween in the absence of the jaw elements.

It is thus a feature of at least one embodiment of the invention to provide a latch that retains its latching function in the event of an appliance fire that might melt the polymer jaw elements.

The spring element may be a U-shaped metal clip having opposing and separated arms attached respectively to upper and lower opposed jaw elements.

It is thus a feature of at least one embodiment of the invention to provide a simple mechanism for biasing opposed jaws inward that provides natural centering of the jaw elements.

The U-shape metal clip may be attached to a housing supporting the spring element and electric switch at a center portion of the U-shape clip substantially midway between the arms.

It is thus a feature of at least one embodiment of the invention to provide a spring element that is easily attached to a housing or frame.

The switch operator may be a lever arm extending from a position behind the opposed jaws along the insertion axis to electrical contacts of the electric switch displaced perpendicularly from the insertion axis from the position behind the opposed jaws.

It is thus a feature of at least one embodiment of the invention to avoid size constraints and contamination problems with respect to the switch that might occur if the switch were to be physically placed behind the jaws.

The electrical contacts may be supported on metal leaf springs extending perpendicularly to the insertion axis.

It is thus a feature of at least one embodiment of the invention to provide a folded switch design reducing the depth of the switch into the appliance.

The U-shaped metal clip may include a slot in one arm and allow passage of the lever arm therethrough.

It is thus a feature of at least one embodiment of the invention to permit the location of the switch to he displaced above the jaws to resist water contamination when the jaws open vertically.

The end of the lever arm behind the opposed jaws may provide a plate extending from either side of the lever arm along a line of contact between the opposed jaws when the jaws are pressed together.

It is thus a feature of at least one embodiment of the invention to relax the necessary tolerance location of the strike by expanding the target on the operator while still allowing insertion of the operator through a lever arm.

The lever arm may include a pivot affixed to a housing supporting the spring element and electric switch to pivot with respect to the housing.

It is thus a feature of at least one embodiment of the invention to increase the separation between the jaws and the switch without decreasing the mechanical action provided to the switch by the operator.

The end of the lever arm extending away from the position behind the opposed jaws may contact an over-center spring providing a snap action opening and closing electrical contacts.

It is thus a feature of at least one embodiment of the invention to provide a snap action switch in a folded switch design that presents a shallow installation depth.

The latch switch assembly may include a housing holding the pair of jaws, the spring element, and the electric switch, wherein the housing provides an opening exposing the opposable jaws along the insertion axis.

It is thus a feature of at least one embodiment of the invention to reduce contamination and exposure of electrical elements of the latch switch assembly.

The opening may include a flange extending outward along a plane around the opening and perpendicular to the insertion axis.

It is thus a feature of at least one embodiment of the invention to provide a housing that operates to provide a finished appearance to the necessary opening in the appliance housing when the latch switch assembly is inserted into the appliance.

The housing may extend upward along a rear side of the plane of the opening behind the flange and is sized to be threadably passed through an aperture in an appliance sized to be covered by the frame when the frame is placed against the aperture.

It is thus a feature of at least one embodiment of the invention to permit installation of the latch strike assembly from a front side of the appliance through the opening required for access to the opposed jaws.

Other features and advantages of the invention will become apparent to those skilled in the art upon review of the following detailed description, claims and drawings in which like numerals are used to designate like features.

BRIEF DESCRIPTION OF THE DRAWINGS

FIG. 1*a* and FIG. 1*b* are a perspective views, respectively, of a frontloading dryer suitable for use with the present invention and an enlarged detail of a latch switch assembly opening at a front housing of the appliance;

FIG. 2 is a fragmentary perspective view of a strike mounted to the appliance door as may be received by the latch/switch of the present invention showing the switch operator supported behind the latch jaws;

Figure 3A:
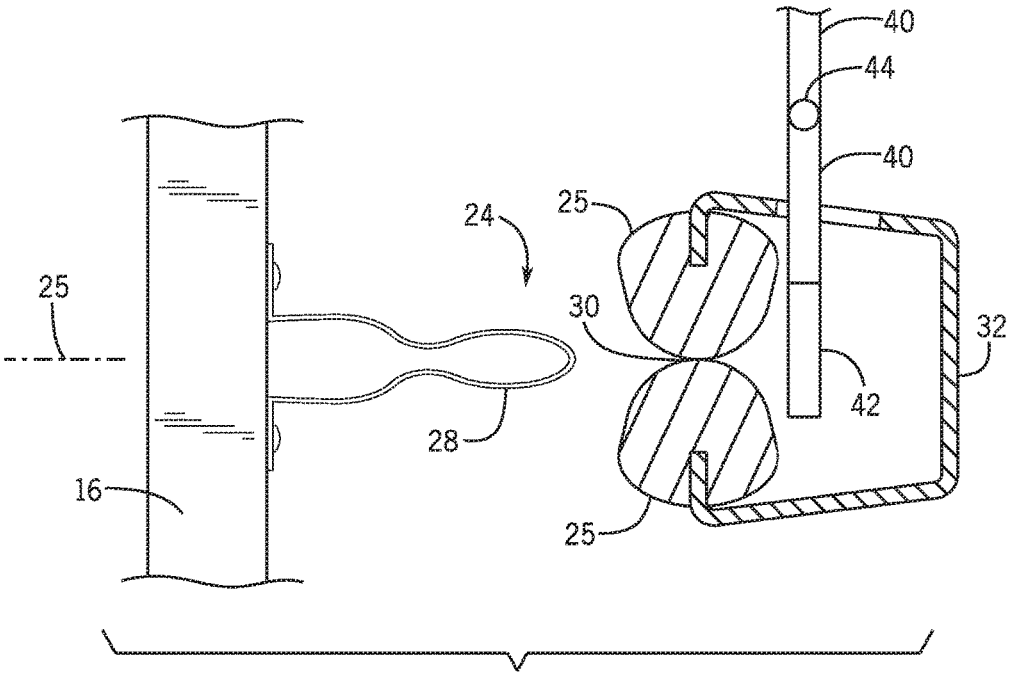
FIG. 3*a* is a side elevational view of the latch/switch before receipt of the switch activator.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, an appliance 10, for example, a front-loading dryer, may provide for a housing 12 having an opening 14 in a front wall 13 for providing a user access to a washing volume 15 of a type well known in the art. The opening 14 may be coverable by a door 16 that may seal against the opening 14 to block the flow of water therethrough. While a washing machine is shown in the following example, the invention may also be used in other appliances subject to contamination including dryers, these appliances referred to herein, generally, as laundry machines.

The door 16 may hinge, for example, about a vertical axis at one edge of the door 16 to a side of the opening 14 so that the opposite edge of the door 16 may swing inwards covering the opening 14 and pressing inward against the front wall 13 of the appliance 10.

The outer edge of the door 16 may hold a strike 24 that may pass through an opening 18 in the front wall 13 of the appliance 10 where it is received by a latch switch assembly 19 which serves to hold the door 16 closed and to actuate contacts of an electrical switch (not shown in FIG. 1) held within a housing 29 of the latch switch assembly 19. The internal contacts provide an electrical signal over leads 41 to a control system of the appliance 10 indicating closure of the door 16 and normally allowing activation of internal mechanisms such as a rotating drum, fan, and heater.

Figure 3B:
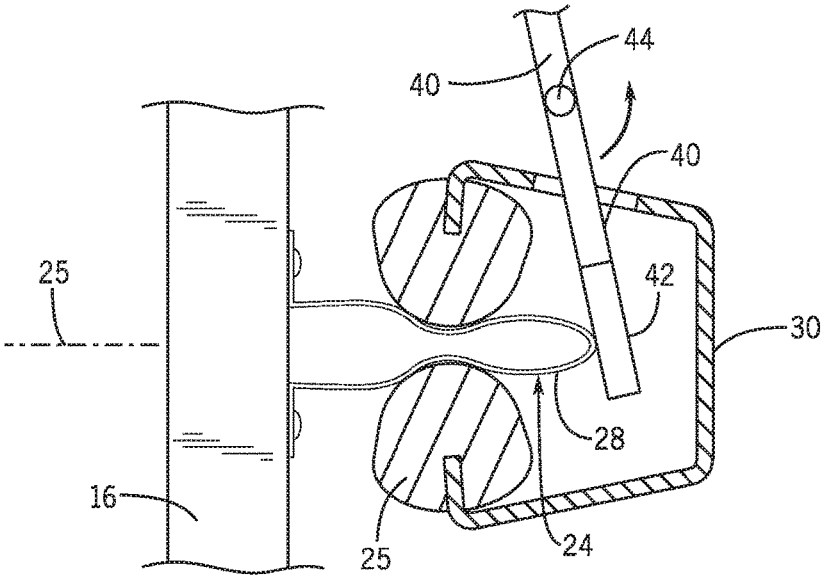
FIG. 3*b* is a figure similar to that of FIG. 3*a* showing the latch/switch after receipt of the latch switch assembly.

Referring now also to FIGS. 2, 3*a* and 3*b*, the strike 24 may include mounting flanges 26 for attaching the strike 24 to the inner surface of the door 16 to extend from the inner surface of the door 16 to provide a bulbous tip 28 projecting toward the latch switch assembly 19 along an insertion axis 27 as the door 16 closes.

The latch switch assembly 19 provides a front opening 22 exposing vertically (the jaws could be horizontally opposed depending on mount orientation) opposed latch jaws 25 that may receive the strike 24. The bulbous tip 28 provides a taper at its front edge that serves to separate the jaws 25 as it is received therebetween and a taper at its rear edge that allows retention of the strike 24 by the jaws 25 closing behind it.

The front opening 22 may be surrounded by a frame flange 21 extending outward along a plane of the opening 22 such as may cover any gaps between the housing 29 and the opening 18 in the appliance 10. When the latch switch assembly 19 is installed as shown in FIG. 2, a rear face of the frame flange 21 abuts a front face of the front wall 13 of the appliance 10.

Generally, the latch jaws 25 may be constructed of a polymer such as a thermoplastic providing a rounded bar extending laterally and contacting at a horizontal line defining a jaw interface 30. When received by the latch switch assembly 19, the strike 24 is positioned in alignment with the jaw interface 30 between the contacting latch jaws 25.

The latch jaws 25 maybe spring biased inward toward each other by a C-clip 32 being a resilient steel or other resilient element mounted by a rivet 33 spot weld or similar attachment means at a rear surface to a housing structure of the latch switch assembly 19. The attachment point may be positioned midway between the arms of the C-clip 32 along axis 27, to promote equal separation of the latch jaws 25 thereabout. The arms of the C-clip 32 are attached to alternate ones of the latch jaws 25 and bias them toward each other. Force by the strike 24 against the interface 30 of the jaws 25 caused by closure of the door 16 causes the jaws 25 to separate in a direction countering the bias force of the C-clip 32. This separation permits the strike 24 to enter the volume inside the C-clip 32 as shown in FIG. 3*b*.

When the strike 24 extends into the volume of the C-clip 32, inward force on the jaws 25 holds the bulbous tip 28 of the strike 24 retained within the volume of the C-clip 32 until sufficient force opening the door 16 is provided that may again spread the jaws 25 to allow exit of the strike 24.

An opening 38 is provided in the upper arm of the C-clip 32 in the form of an axially extending slot allowing a lever 40 to pass downward into the volume of the C-clip to terminate at a paddle 42 which provides a switch operator. The paddle 42 may provide a widened surface behind the interface 30 ensuring that it is contacted by the strike 24 when the strike 24 passes into the volume of the C-clip 32. Generally the paddle 42 provides surfaces extending from an end of the lever 40 perpendicular to the insertion axis 27 and generally parallel to the extension of the interface 30 during operation. The width of the paddle 42 is such that it can be inserted through the opening 38, for example, by 90 degree rotation of the lever 40 minimizing any weakening of the C-clip 32 from the opening 38.

A similar opening 38 (not shown) can be placed in the lower arm of the C-clip 32 to equalize the force needed to deflect both arms and allow for assembly without regard for orientation of the C-clip 32.

The lever 40 pivots about a horizontally extending fulcrum bar 44 to provide a pivot above the opening 22 so that the paddle 42 may swing within the volume of the C-clip 32 toward and away from the interface 30 of the jaws 25. As shown in FIG. 3*a*, when the strike 24 is removed from the interior volume of the C-clip 32, the lever 40 may be substantially vertical with the paddle 42 displaced toward the interface 30 of the jaws 25. When the strike 24 passes into the volume of the C-clip 32 through the jaws 25, the paddle 42 is displaced rearward by the bulbous tip 28 and the lever 40 rotates about the fulcrum bar 44 in a generally counterclockwise direction as shown in FIG. 3*b*.

Figure 4A:
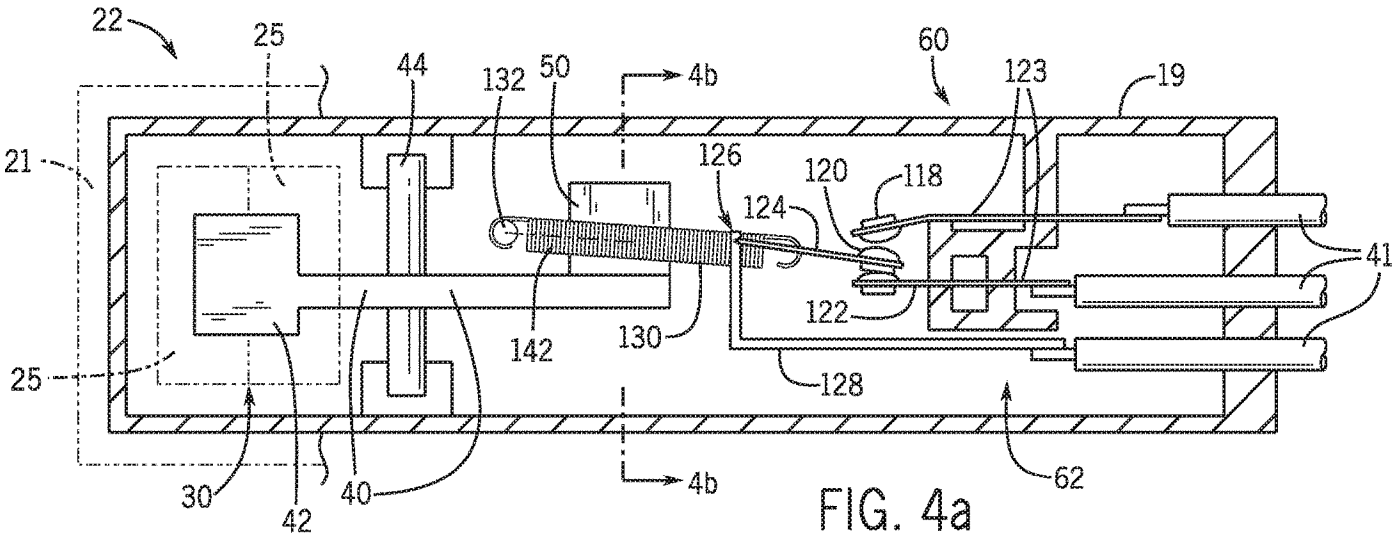
FIG. 4*a* is an elevational cross-section along line 4*a*-4*a* of FIG. 1 showing a mechanical linkage between the switch operator and an over-center spring mechanism for moving a center contact between two outer-flanking contacts each connected to different ones of the conductors.
Figure 4B:
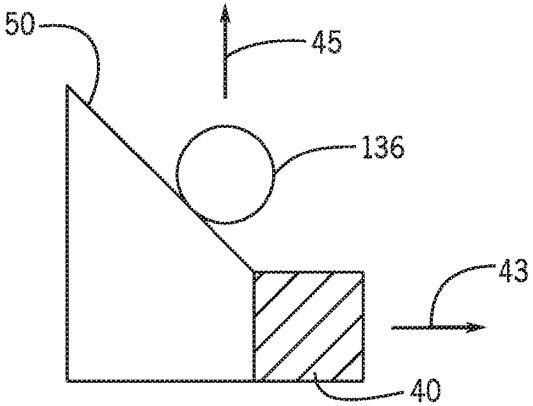
FIG. 4*b* is an plan view cross-section along line 4*b*-4*b* of FIG. 4*a* showing a cam surface on the mechanical linkage pressing on the over-center spring.

Referring now to FIGS. 4*a* and 4*b*, the housing 29 of the latch switch assembly 19 may be constructed of an insulating thermoplastic material molded to include the opening 22 through which the strike 24 may be received and to otherwise enclose and protect other components of the latch switch assembly 19. Conductive leads 41 may extend through other openings in the housing 46 to communicate with external electrical circuits, for example, motors or actuators of a household appliance (not shown).

The latch switch assembly 19 may contain an upper contact 118, a center contact 120, and a lower contact 122 arranged to provide a single pole, double throw electrical switch with the upper contact 118 and lower contact 122 generally flanking the center contact 120. The center contact 120 may move between the upper contact 118 and lower contact 120 to selectively and alternatively connect to only one of the upper contact 118 and lower contact 122.

The center contact 120 may be supported on a relatively rigid conductive lever 124 attached at a knife-edge pivot point 126 to a conductive support bracket 128, the latter communicating with one of the conductive leads 41 and pivot point 126 allowing electrical conduction from the conductive lever 124 to the conductive lead 41. By pivoting the lever 124 around the pivot point 126, the lever 124 may be moved upward and downward so that the center contact 120 alternately connects electrically to upper contact 118 and lower contact 122.

A helical over-center spring 130 attaches to a center portion of the lever 124 and extends away from the center contact 120 to a support post 132 on the housing 46 to provide a force on the lever 124 tending to engage the lever 124 and support bracket 128 at the pivot point 126.

The paddle 42, when pressed inward (into the page as depicted in FIG. 4*a*), causes inward motion of the lever on the side of the fulcrum bar 44 including the paddle 42 and outward motion of the lever 40 on the opposite side of the fulcrum bar 44. A cam surface 50 (shown also in FIG. 4*b*) attached at the opposed end of the lever 40 pushes outward as indicated by arrow 43 which deflects a center region of the helical over-center spring 130 upward indicated by arrow 45 to change its line of action 142 with respect to the pivot point 126. The line of action 142 represents a force vector asserted on the lever 124 by the helical over-center spring 130. When the line of action 142 is above the pivot point 126, the lever 124 will snap rapidly upward, and when the line of action 142 is below the pivot point 126, lever 124 will snap rapidly downward.

Referring still to FIGS. 4*a* and 4*b*, the upper contact 118 and lower contact 122 are each generally supported on cantilevered conductive metal leaf springs 123 which communicate to one of the conductive leads 41. Generally the metal leaf springs 123 extend from their respective contacts 118 and 122 in the opposite directions as the lever 124 so that the conductive leads 41 may exit from a top of the housing 29 to reduce the chance of water ingress.

When the strike 24 is removed from the latch switch assembly 19, the paddle 42 is released and the lever 40 rotates so that the line of action 142 of the helical over-center spring 130 moves below the pivot point 126, and a lower surface of the center contact 120 contacts an upper surface of the lower contact 122 at a first position as pulled together by a torsional vector component of the force along the line of action 142 of the over-center spring 130, the force pulling downward on lever 124. An upper surface of contact 120 is separated from a lower surface of the upper contact 118 so that a circuit is "made" between contacts 121 and 122 and "broken" between contacts 121 and 118.

Figure 5B:
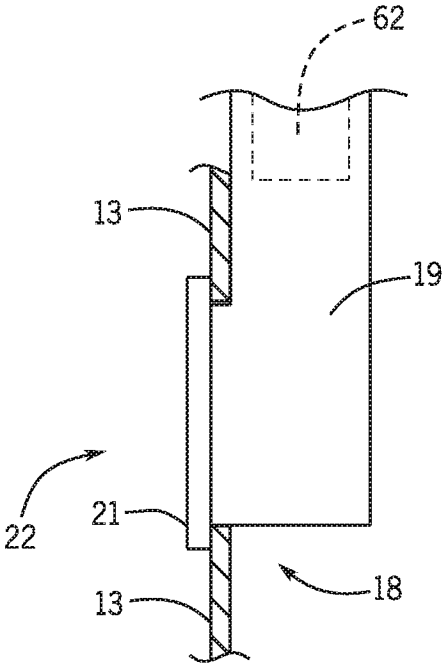
FIGS. 5*a* and 5*b* are side elevational cross-sectional views through the front wall of an appliance showing insertion of the latch switch assembly the present invention.
Figure 5A:
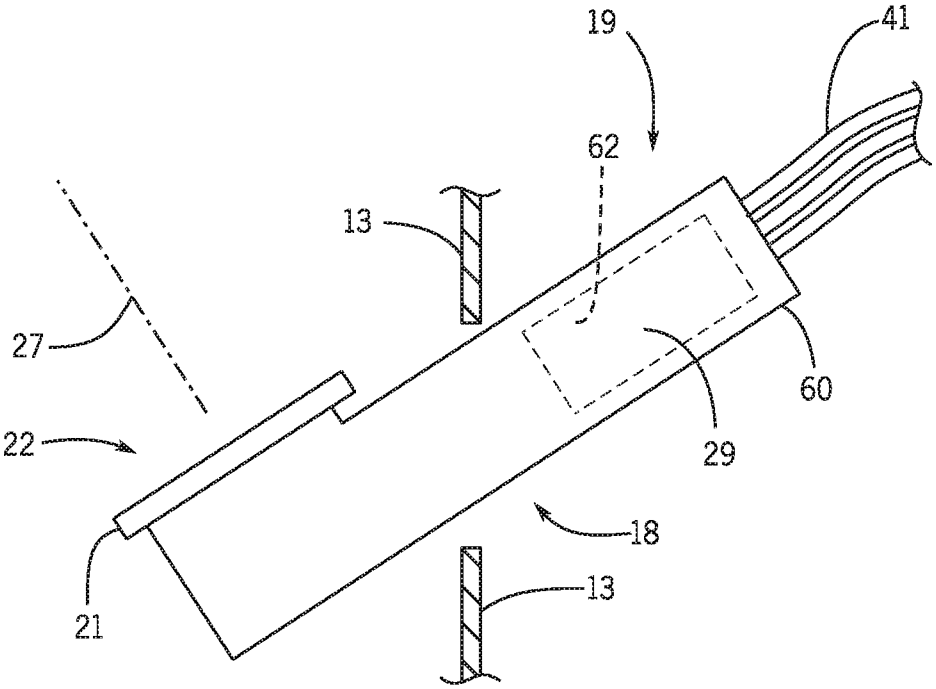

Referring now to FIGS. 5*a* and 5*b*, the housing 29 provides an elongate section 60 holding electrical switch 62 of contacts 118 and 122 displaced away from the insertion axis 27 so that the electrical switch 62 may be mounted above the opening 22 when the frame flange 21 abuts the rear surface of the front wall 13 around the opening 18. In this position, the elongate section 60 extends along a rear surface of the front wall 13 closely adjacent thereto. For installation purposes, the cross-sectional dimensions of the elongate section 60 are sized to fit freely through the opening 18 and the opening 18 sized with respect to the frame flange 21 to allow the housing 29 to be rocked into a vertical position during installation after the elongate section 60 passes through the opening 18.

Various of the components of the switch 48 as described above are the subject of co-pending application publication number 2013/0015049 published Jan. 17, 2013, and hereby incorporated in its entirety by reference as well as.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. A latch switch assembly adapted to accept and retain a latch strike, the latch switch assembly comprising:

a pair of jaw elements movable in separation toward and away from each other across an insertion axis;

a spring element biasing the jaw elements toward each other so that they may separate to receive the latch strike along the insertion axis and hold the latch strike in contact with the latch strike after receipt under force of the spring element; and an electric switch having an operator positioned behind the jaw elements with respect to a direction of receipt of the latch strike along the insertion axis to be operated by the latch strike when so received;

wherein the jaw elements are a polymer material and wherein the spring element provides metal teeth fitting within the jaw elements to grip the latch strike positioned therebetween in an absence of the jaw elements.

2. The latch switch assembly of claim 1 wherein the spring element is a U-shaped metal clip having opposing and separated arms attached respectively to upper and lower opposed jaw elements.

3. The latch switch assembly of claim 2 wherein the U-shaped metal clip is attached to a housing and the electric switch at a center portion of the U-shaped metal clip substantially midway between the arms.

4. The latch switch assembly of claim 1 wherein the switch operator is a lever arm extending from a position behind the jaw elements with respect to the insertion axis to electrical contacts of the electric switch which are displaced perpendicularly from the insertion axis from the position behind the jaw elements.

5. The latch switch assembly of claim 4 wherein at least one electrical contact is supported on metal leaf springs extending perpendicularly to the insertion axis.

6. The latch switch assembly of claim 4 wherein the lever arm includes a pivot affixed to a housing supporting the spring element and the electric switch to pivot with respect to the housing.

7. The latch switch assembly of claim 4 wherein an end of the lever arm extending away from the position behind the jaw elements contacts an over-center spring providing a snap action opening and closing of electrical contacts.

8. The latch switch assembly of claim 7 further including a housing holding the jaw elements, the spring element, and the electric switch, wherein the housing provides an opening exposing the jaw elements along the insertion axis.

9. The latch switch assembly of claim 8 wherein the opening includes a flange extending outward along a plane around the opening and perpendicular to the insertion axis.

10. The latch switch assembly of claim 9 wherein the housing extends upward along a rear side of the plane of the opening behind the flange and is sized to be threadably passed through an aperture in an appliance sized to be covered by the flange when the flange is placed against the aperture.

11. The latch switch assembly of claim 1 further including a latch strike having a bulbous distal end tapered at a front of the bulbous distal end to separate the pair of jaw elements as the latch strike is moved along the insertion axis so that the pair of jaw elements separate to pass over the bulbous distal end with insertion of the latch strike along the insertion axis and move together to behind the bulbous end with a spring force to retain the latch strike against a predetermined retraction force.

12. A latch switch assembly adapted to accept and retain a latch strike, the latch switch assembly comprising:

a pair of jaw elements movable in separation toward and away from each other across an insertion axis;

a spring element in a form of a U-shaped metal clip having opposing and separated arms attached respectively to upper and lower opposed jaw elements, the spring element biasing the jaw elements toward each other so that they may separate to receive the latch strike along the insertion axis and hold the latch strike in contact with the latch strike after receipt under force of the spring element; and an electric switch having an operator in a form of a lever arm extending from a position behind the jaw elements with respect to a direction of receipt of the latch strike along the insertion axis to be operated by the latch strike when so received, the electrical switch having electrical contacts displaced perpendicularly from the insertion axis away from the position behind the jaw elements to be outside the U-shaped metal clip;

wherein the U-shaped metal clip includes at least one slot in one arm allowing passage of the lever arm therethrough.

13. The latch switch assembly of claim 12 wherein an end of the lever arm behind the upper and lower opposed jaw elements provides a plate extending from either side of the lever arm along a line of contact between the upper and lower opposed jaw elements when the jaw elements are pressed together.

* * * * *